US012213570B2

(12) United States Patent
Martinez

(10) Patent No.: US 12,213,570 B2
(45) Date of Patent: Feb. 4, 2025

(54) PORTABLE PERSONAL STORAGE DEVICE

(71) Applicant: Elvis E. Martinez, Las Vegas, NV (US)

(72) Inventor: Elvis E. Martinez, Las Vegas, NV (US)

( * ) Notice: Subject to any disclaimer, the term of this patent is extended or adjusted under 35 U.S.C. 154(b) by 0 days.

(21) Appl. No.: 17/733,130

(22) Filed: Apr. 29, 2022

(65) Prior Publication Data

US 2022/0346513 A1 Nov. 3, 2022

Related U.S. Application Data

(60) Provisional application No. 63/181,674, filed on Apr. 29, 2021.

(51) Int. Cl.

| | |
|---|---|
| ***A45C 13/00*** | (2006.01) |
| ***A45C 11/00*** | (2006.01) |
| ***A45C 11/24*** | (2006.01) |
| ***A45C 15/04*** | (2006.01) |

(52) U.S. Cl.

CPC ..... *A45C 13/00* (2013.01); *A45C 11/008* (2013.01); *A45C 11/24* (2013.01); *A45C 15/04* (2013.01); *A45C 2011/002* (2013.01)

(58) Field of Classification Search

CPC ..... A45D 33/26; A45D 33/16; A45D 33/28; B65D 43/20

See application file for complete search history.

(56) References Cited

U.S. PATENT DOCUMENTS

| | | | | |
|---|---|---|---|---|
| 1,632,864 | A * | 6/1927 | Weber | A45D 33/28 132/297 |
| 4,555,020 | A * | 11/1985 | Campello | A45D 40/22 206/823 |
| 6,311,077 | B1 | 10/2001 | Bien | |
| 6,363,947 | B1 * | 4/2002 | Wu | A45D 40/24 132/297 |
| 6,522,613 | B1 * | 2/2003 | Frankeny | G11B 33/0405 |
| 6,788,919 | B2 | 9/2004 | Watanabe | |
| 7,146,184 | B1 | 12/2006 | Tsitsiashvili | |
| 7,340,238 | B2 | 3/2008 | Napier-Clark | |
| 7,431,161 | B2 | 10/2008 | Carlino | |
| 7,975,706 | B2 * | 7/2011 | Chen | A45D 40/24 206/581 |

(Continued)

FOREIGN PATENT DOCUMENTS

| | | |
|---|---|---|
| CN | 202722868 U | 2/2013 |
| KR | 200177008 Y1 | 4/2000 |

(Continued)

*Primary Examiner* — Ernesto A Grano
*Assistant Examiner* — Symren K Sanghera
(74) *Attorney, Agent, or Firm* — BEKIARES ELIEZER LLP

(57) ABSTRACT

Provided herein are various portable personal storage devices and methods of use of the same. In one aspect, the device includes a housing configured to attach to a surface, the housing comprising: a plurality of predefined cavities configured to removably store a wellness instrument and/or container, each cavity comprising an opening defining said cavity and disposed on an outer surface of the housing; at least one of: a replaceable wellness instrument and/or container; and a housing cover slidably connected to a surface of the housing.

15 Claims, 14 Drawing Sheets

(56) References Cited

U.S. PATENT DOCUMENTS

| | | | | |
|---|---|---|---|---|
| 8,276,599 | B2 | 10/2012 | Gindi | |
| 8,833,379 | B1 | 9/2014 | Kaplan | |
| 9,643,767 | B2 | 5/2017 | Ziemba | |
| 9,876,523 | B2 | 1/2018 | Hodroj | |
| D819,620 | S | 6/2018 | Parker | |
| 10,595,611 | B2 * | 3/2020 | Berkley | A45C 13/005 |
| 2005/0274733 | A1 * | 12/2005 | Fusi | G07F 11/44 221/232 |
| 2009/0288677 | A1 * | 11/2009 | Chen | B43L 23/08 30/457 |
| 2011/0089078 | A1 * | 4/2011 | Ziemba | A45C 13/10 206/581 |
| 2012/0264491 | A1 | 10/2012 | Singhal | |
| 2014/0084010 | A1 * | 3/2014 | Wan | A45D 33/006 220/525 |
| 2015/0201733 | A1 * | 7/2015 | Brogoitti | A45D 40/18 132/288 |
| 2018/0099093 | A1 * | 4/2018 | Ebert | A61M 5/32 |
| 2019/0069661 | A1 | 3/2019 | Worley | |
| 2019/0142134 | A1 * | 5/2019 | Kim | A45C 15/00 206/581 |
| 2021/0156147 | A1 * | 5/2021 | Fermanian | E04B 2/18 |
| 2021/0274911 | A1 * | 9/2021 | Forbes | A45D 33/008 |
| 2021/0281942 | A1 * | 9/2021 | Feng | H04R 1/1033 |
| 2022/0111139 | A1 * | 4/2022 | Fireman | A61M 5/002 |

FOREIGN PATENT DOCUMENTS

| | | | |
|---|---|---|---|
| KR | 100358791 | B1 | 10/2002 |
| KR | 1020170050667 | A | 5/2017 |
| KR | 1020180062840 | A | 6/2018 |
| KR | 1020180089678 | A | 8/2018 |
| WO | 2021005113 | A1 | 1/2021 |

* cited by examiner

PORTABLE PERSONAL STORAGE DEVICE

RELATED APPLICATION

The present application claims benefit under the provisions of 35 U.S.C. § 119(e) of U.S. Provisional Application No. 63/181,674 filed on Apr. 29, 2021, and having inventors in common, which is hereby incorporated by reference in its entirety.

It is intended that the above-referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to portable housings, casings or accessories for storing or dispensing compositions and tools for personal use.

BACKGROUND OF THE DISCLOSURE

Keeping track of small personal items is an increasing problem in today's mobile society. For example, people with certain illnesses or conditions must always travel with a particular medical device or subscription medication. Failure to bring this medical device or prescription medication may result in significant injury or even death. However, many such devices or medications include small components that are easily lost within a larger container, such as a purse or other travel bag. Furthermore, the user may forget to transfer the necessary items when switching from one travel bag to another.

Other small personal items that may not be medically necessary are still deemed important to a person's overall wellness and must be reliably transported. For example, people may want to ensure that they have some kind of breath freshener, e.g., a mint or gum, accessible at in-person events. Others may desire to apply beauty or cosmetics products to their face while on the go. For example, a person may need to apply lip gloss and/or blush in their car just prior to an event. Conventionally, cosmetics are applied while looking in a bathroom mirror or stationary mirror. While this may be the ideal method, this is not always possible. For example, someone may desire to apply or touch up cosmetics in an environment where a bathroom mirror is unavailable or where they do not have access to a cosmetic bag. Even if available, the person may be limited to using a pocket mirror and limited types of cosmetics. This creates problems because it does not allow a person to access to the desired cosmetics.

Accordingly, there remains a need for improved storage devices that are both portable and can store and provide a variety of small items that contribute to a person's health and/or wellness. This need and other needs are satisfied by the various aspects of the present disclosure.

BRIEF OVERVIEW

In various aspects, a portable personal storage device may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

One example embodiment of a personal storage device comprises a housing configured to attach to a surface via a first magnetic attachment mechanism, at least one of a replaceable wellness instrument or container, and a housing cover slidably connected to a front surface of the housing via a second magnetic attachment mechanism. The housing may comprise a plurality of predefined cavities, with each of the plurality of predefined cavities being configured to removably store one or more wellness instruments and/or containers. Each of the plurality of predefined cavities may further comprise an opening disposed on an outer surface of the housing.

In some embodiments, the first magnetic attachment mechanism comprises one or more magnets disposed within a back portion of the housing, the one or more magnets being effective to detachably couple the housing to a magnetic surface. The magnetic surface may be a base plate configured to attach to the surface via an adhesive mechanism. In some embodiments, the second magnetic attachment mechanism comprises one or more magnets disposed within a front portion of the housing.

In some embodiments, the housing cover and the housing comprise a tongue and slot connecting arrangement configured to guide the housing cover along a predetermined travel path. In some embodiments, movement of the mirror along the predetermined travel path is effective to eject at least one of the one or more wellness containers from at least one of the plurality of predefined cavities via engagement of the tongue of the housing cover with a beveled surface of the at least one wellness container. The housing cover may comprise a mirror or mirrored surface, and/or the housing cover may comprise a display screen.

The plurality of predefined cavities may be disposed on any outer surface of the housing. In some embodiments, at least two of the plurality of predefined cavities are disposed on opposing lateral surfaces of the housing. In some embodiments, at least two of the plurality of predefined cavities are disposed on a front surface of the housing.

In some embodiments, each of the plurality of predefined cavities has a low percentage of open space once the one or more wellness instruments and/or containers are placed therein. In some embodiments, a volume of the plurality of predefined cavities constitutes greater than 70% of the total volume of the housing.

The replaceable wellness instrument and/or container may be anything contributing to a person's overall wellness, e.g., health, feeling, appearance, and/or confidence. In some embodiments, the replaceable wellness instrument is lip gloss, lip stick, an applicator, or the like. In some embodiments, the replaceable wellness container is a container for storing wellness media. The wellness media may be a powdered or liquid wellness media. In other embodiments, the wellness media may be blush, foundation, or eye shadow.

Also provided herein is an example method of utilizing wellness products. The method may comprise detachably coupling a housing to a base plate via a first magnetic attachment mechanism, wherein the base plate is configured to permanently attach to a surface. The method may further involve removing a wellness instrument from an opening defined by a lateral surface of the housing. In some embodiments, the method involves sliding a housing cover along a top surface of the housing to expose at least one disposable tray having wellness media stored therein. The housing cover may be attached to the housing via a second magnetic attachment mechanism. The method may further involve utilizing the wellness instrument and/or the wellness media. In some embodiments, the method further comprises permanently attaching the base plate to the surface via an adhesive attachment mechanism.

In some embodiments, the wellness container is an applicator container housing an applicator therein, and the wellness media is a cosmetic media configured to be applied to a person using an applicator. In some embodiments, the surface is a mobile device case.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are explanatory only and are not restrictive of the disclosure, as claimed.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE DISCLOSURE

Figure 1:
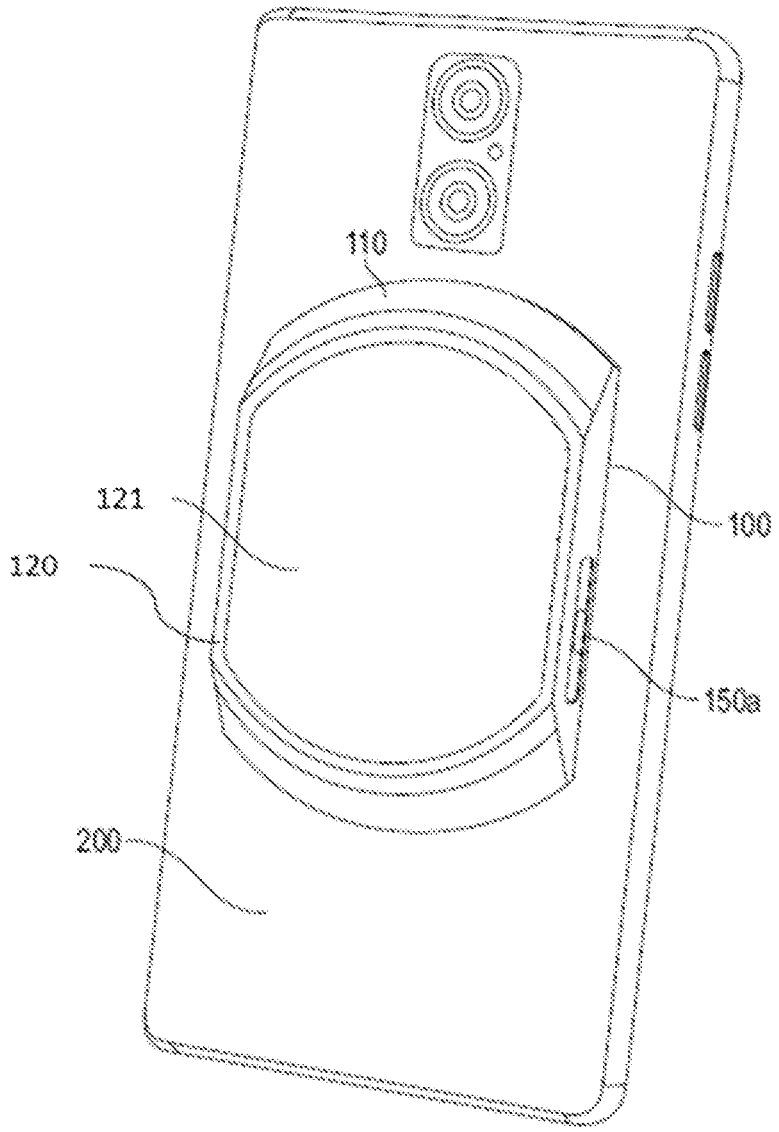
FIG. 1 is a perspective view of an example embodiment of a portable personal storage device removably attached to a surface.

The present disclosure includes many aspects and features. Moreover, while many aspects and features relate to, and are described in, the context of portable device assembly for cosmetics, embodiments of the present disclosure are not limited to use only in this context. The present disclosure can be understood more readily by reference to the following detailed description of the disclosure and the Examples included therein.

Before the present devices, articles, systems, apparatuses, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this disclosure belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed apparatuses, systems, and articles of the disclosure as well as the apparatuses themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and apparatuses of the disclosure. Thus, if there are a variety of additional steps that can be performed it is understood that each of these additional steps can be performed with any specific aspect or combination of aspects of the methods of the disclosure.

It is understood that the apparatuses and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Personal Storage Device Overview

Consistent with embodiments of the present disclosure, a portable personal storage device may be provided. This overview is provided to introduce a selection of concepts in a simplified form that are further described below. This overview is not intended to identify key features or essential features of the claimed subject matter. Nor is this overview intended to be used to limit the claimed subject matter's scope. The mirror and assembly may be used by individuals or companies to utilize a collapsible, hands free, cosmetics mirror in a hanging, standing, wearable, or collapsed position of operation.

Consistent with embodiments of the present disclosure, a portable personal storage device may be configured to store and/or dispense a variety of products that contribute to personal wellness, where wellness is broadly defined to include maintenance and/or enhancement of a person's health, feeling, appearance, and/or confidence. The personal storage device may include a mirror cover and may contain removable wellness tools and compositions therein. The personal storage device may be used by individuals on the go to utilize various types of removeable wellness compositions, e.g., cosmetics, oral medications such as pills, topical medications such as ointments or lotion, portable medical devices, etc., contained within a device housing.

In one aspect, the personal storage device may be a beauty tool, accessory, or cosmetic apparatus. In another aspect, the personal storage device may be used in a manner similar to a typical makeup mirror and accessory. In yet another aspect, the personal storage device may provide operative ability to be collapsed and be used in one or more different positions of operation.

In one embodiment, a personal storage device may contain one or more wellness tools or compositions that may be releasably coupled to or stored within predefined cavities in the housing. The wellness tools or compositions may be removably coupled or stored within the cavities using various attachment mechanisms including but not limited to: magnets, fasteners, friction fit, interlocking components, and the like.

In further aspects, the disclosure also relates to a personal storage device which may comprise a storage housing or container which may be used "on-the-go", but in a manner similar to an at-home vanity. The storage housing may be portable and configured to attached to a surface, such as, for example, a mobile phone case surface, using an attachment mechanism. Further, in other instances, the disclosure may relate to a housing which may have an internal attachment mechanism that may allow wellness tools and/or compositions to be releasably stored within the housing.

In still further aspects, the disclosure relates to a portable and detachable personal storage device having a wellness storage housing with a slidable housing cover which may be configured to function in one or more configurations. In some aspects, sliding of the housing cover with respect to the housing may be effective to eject one or more of the wellness instruments and/or containers stored within the housing.

In a first possible configuration, the wellness device may be releasably attached to the back of a mobile item, e.g., a mobile phone, a mobile phone case, a purse handle, a belt, a garment, a garment pocket, etc. In a second possible configuration, the personal storage device may be releasably attached to stationary structure, e.g., a mirror or magnetic surface. In even further aspects, part or all of the attachment mechanism or means may optionally be integrated into the housing.

According to various aspects of the invention, the disclosed devices, systems, and methods can comprise multiple configurations. For example, aspects of various example embodiments of the inventive devices, apparatuses, tools, systems, and methods are shown in FIGS. 1-13.

Personal Storage Device Configuration

In one example embodiment illustrated in FIG. 1, a portable personal storage device 100 is provided that comprises a housing 110 configured to detachably couple to a surface 200. The housing 110 may have one or more cavities 150 formed therein for removably storing one or more wellness instruments, containers, and/or media. In further aspects, the device 100 may comprise a housing cover 120 slidably connected to a front surface 111 of the housing 110. The housing cover 120 may comprise a mirror 121 to assist with use of the wellness instruments and/or self-application of media contained within the housing 110. Various attachment mechanisms may be employed for the detachable coupling of the housing 110 to the surface 200 and for the sliding connection of the housing 110 and the housing cover 120. In some embodiments, the housing 110 is configured to be detachably coupled to the surface 200 via a first magnetic attachment mechanism and the housing cover 120 is configured to slidably connect to the housing 110 via a second magnetic attachment mechanism that is sufficiently spaced apart from the first magnetic attachment mechanism to avoid interference between the two magnetic attachment mechanisms.

In general, the housing 110 may be configured for removably storing one or more wellness instruments, containers, and/or media. The housing 110 may be any shape, and preferably conforms to most hands, particularly fingers. For example, various areas may be planar so to allow the wellness instruments and/or containers to be inserted and stored and various areas may be concave or convex so to conform to areas to which the device 100 may be slid open. In the illustrated embodiment, the housing 110 is substantially shaped as a rectangle having first opposing sides that are planar and second opposing sides with a convex curvature, e.g., to conform to a concave portion of a user's palm. In this embodiment, corners of the housing 110 are rounded to avoid sharp edges that might be uncomfortable when gripping the device 100. Any other shape (as used herein, the term shape is used in the broad sense of three-dimensional works) may be employed, so long as the shape is large enough and structured so as to be able to contain the various working components of the invention as more fully disclosed herein. The housing 110 may be comprised of plastic, plastic composite, reinforced plastic, metal, metal composite, or combinations thereof. In still further aspects, the plastic may comprise polypropylene, impact resistant plastic, or the like.

The housing 110 may comprise one or more predefined cavities or pockets 150 configured to removably store one or more wellness instruments, containers, and/or media. The wellness instruments, containers, and/or media may be all housed within the housing 110 such that they are protected from, for example, inadvertent removal or the environmental elements. Each cavity 150 may comprise an opening defining said cavity 150 and disposed on an outer surface of the housing 110, e.g., a top surface 112, a bottom surface 114, a lateral surface 113, and/or a front surface 111. Now referring to the illustrated embodiment of FIG. 3, the housing 110 may comprise four cavities 150*a*, 150*b*, 150*c*, and 150*d*. The cavities 150*a*, 150*b*, 150*c*, 150*d* may be any shape suitable for holding or housing the one or more wellness instruments and/or containers. In the illustrated embodiment first and second cavities 150*a*, 150*b* each have a substantially rectangular-shaped cross section, which defines a substantially rectangular-shaped opening on opposing lateral surfaces 113*a*, 113*b* of the housing 110. The first and second cavities 150*a*, 150*b* may be spaced apart from each other along a longitudinal axis of the housing 110 to allow for both cavities 150*a*, 150*b* to extend adjacent to each other along a majority of the horizontal width of the housing 110. In further aspects, the cavities 150*a*, 150*b* extend along nearly the entire horizontal width of the housing 110. Third and fourth cavities 150*c*, 150*d* may define openings that are disposed on the top surface 111 of the housing 110. The openings defined by the cavities 150*c*, 150*d* may be of a substantially triangular shape, with one side having a convex curvature corresponding to a curvature of the top surface 112 of the housing 110. All of the cavities 150*a*, 150*b*, 150*c*, 150*d* may be spaced apart from each other sufficiently to avoid overlap, but may be close enough to ensure that there is minimal unused space within the housing 110 when the wellness instruments and/or containers are stored therein. In some embodiments, the housing 110 may be a generally hollow structure, primarily comprised of the one or more cavities 150 that are sized to contain the one or more wellness instruments and/or containers. By way of non-limiting example, a volume of the predefined cavities 150 may constitute about 60% to 90% of the total volume of the housing 110.

In various further aspects, the predefined cavities 150 may comprise interior sections sized and shaped to contain wellness instruments and/or containers. In further aspects, walls of the interior sections may define the interior space, and in some embodiments, have a low percentage of open space once the instrument and/or container are positioned in the interior section. In still further aspects, the interior section is substantially free of or free of open space between the interior section walls and the inserted component. Without wishing to be bound by a particular theory, the absence of open space can allow for operation and prevention of interference of the attachment mechanisms.

Wellness instruments, containers, and/or media may be removably positioned within each of the plurality of cavities 150 via a variety of attachment mechanisms, e.g., friction, brackets, magnets, adhesives, fasteners, fitting, or a closure on mouth or opening of instrument and/or container. For example, in some embodiments, the wellness instrument and/or container may be pushed in place. In yet further aspects, the wellness container may be removed by pushing out using an aperture in the housing 110 located behind the cavity or pocket 150. In some embodiments, the wellness instrument and/or container may be removed using a spring assisted mechanism. In other embodiments, the wellness instrument and/or container may be ejected from the housing upon sliding movement of the housing cover 120 with respect to the housing 110, as described in more detail below.

Wellness instruments and/or containers may be placed within housing 110 during manufacture or at any time after manufacture. In further aspects, while the wellness instruments and/or containers described herein may be permanently mounted in or on the device housing 110, this is not a requirement. For example, the wellness instrument and/or container may be a disposable and/or refillable instrument or container configured to be removably mounted in or on a portion of the device 100, e.g., to allow interchange and/or replacement, such as, for example, when the wellness composition is used up. Such configurations allow users to select desired wellness instruments and media in the device, e.g., for customization purposes, for health needs, personal preferences, to match desired use, a subject's physical characteristics, or the like. To this end, the housing 110 may use an ingress and egress element, as various embodiments of may require exchanging or replacement on occasion.

Wellness instruments as disclosed herein may be any desired wellness tool or implement such as, but not limited to small medical devices for personal use, pills or ointments, breath mints, gum, or a cosmetic such as lip gloss, lip stick, an applicator, or the like. Wellness containers as disclosed herein may be any conventional container capable of storing and transferring any media or composition, such a cartridge or vessel. In still further aspects, the wellness container may be a replaceable container or the like. Where the wellness device is configured to store cosmetic media, the cosmetic media may comprise a solid and/or powdered cosmetic composition or media. In even further aspects, the cosmetic media may comprise blush, foundation, eye shadow, mascara, eye liner, lip gloss, lip stick, and the like. In still further aspect, components of the wellness instruments and/or containers may be integrally or mechanically attached to other components of the wellness instruments and/or containers. In a yet further aspect, the disclosed components of the wellness instruments and/or containers can be connected, attached, or mounted using a connecting means, the connecting means comprising a fitting, insert, adhesive, brazing, soldering, welding, spot weld, screw with nut, rivet, fitting, insert, threading, friction fit, press-fit, or snap-fit or a combination thereof.

Figure 4A:
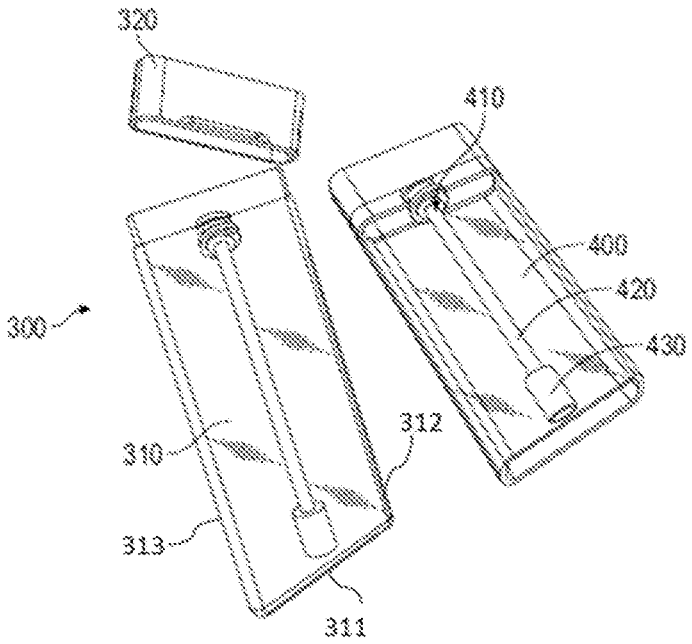
FIGS. 4*a*-4*d* are various views of an example embodiment of a container of the portable personal storage device of FIG. 1.
Figure 4B:
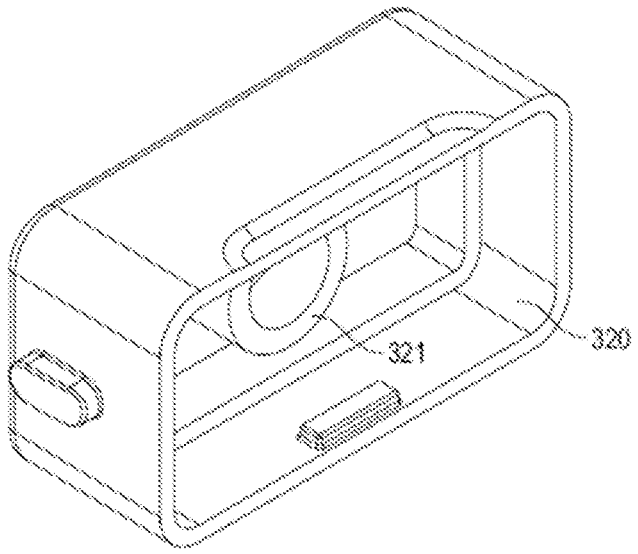
Figure 4C:
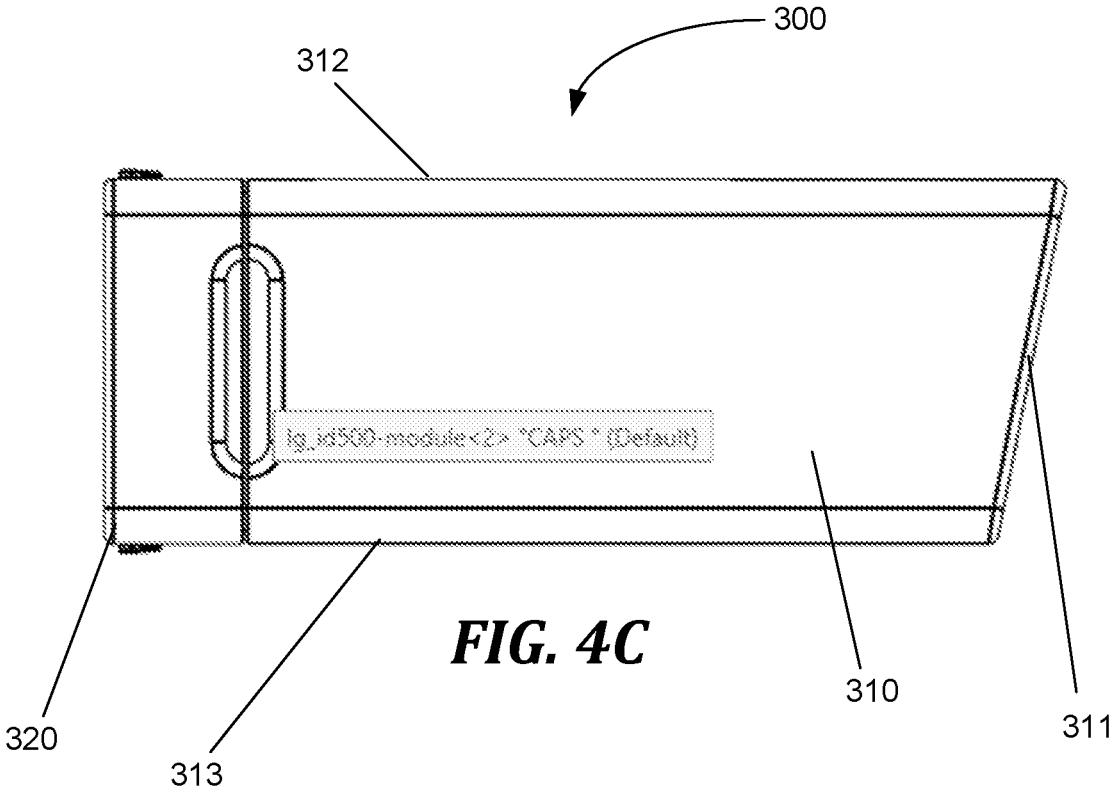
Figure 4D:
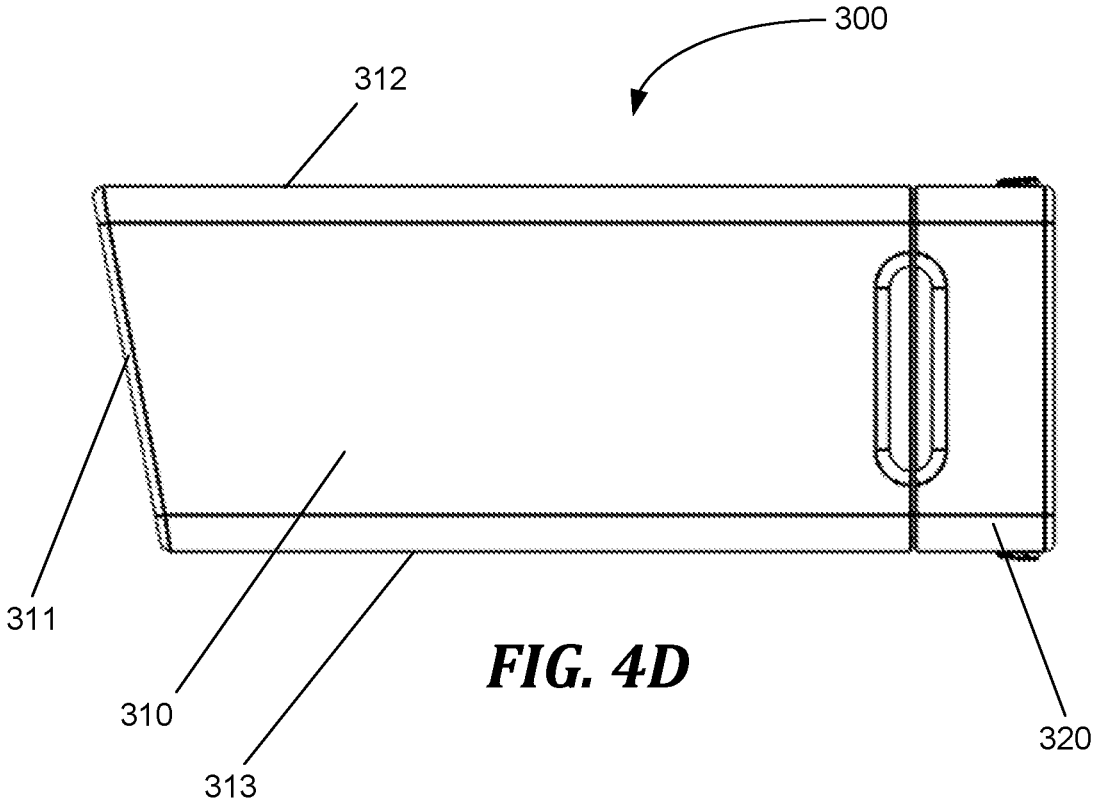
Figure 5:
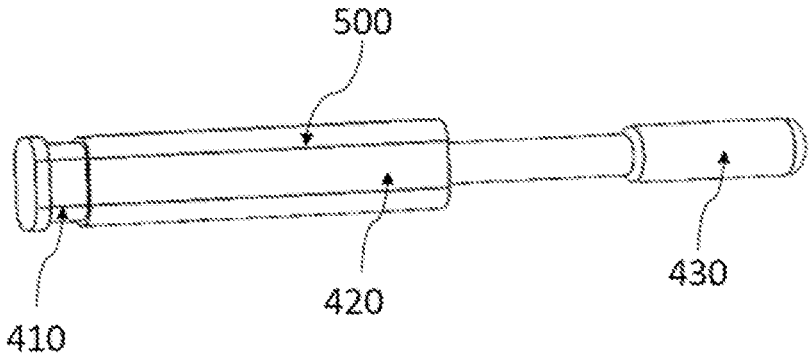
FIG. 5 is a perspective view of an example embodiment of a cosmetic instrument of the portable personal storage device of FIG. 1.
Figure 6A:
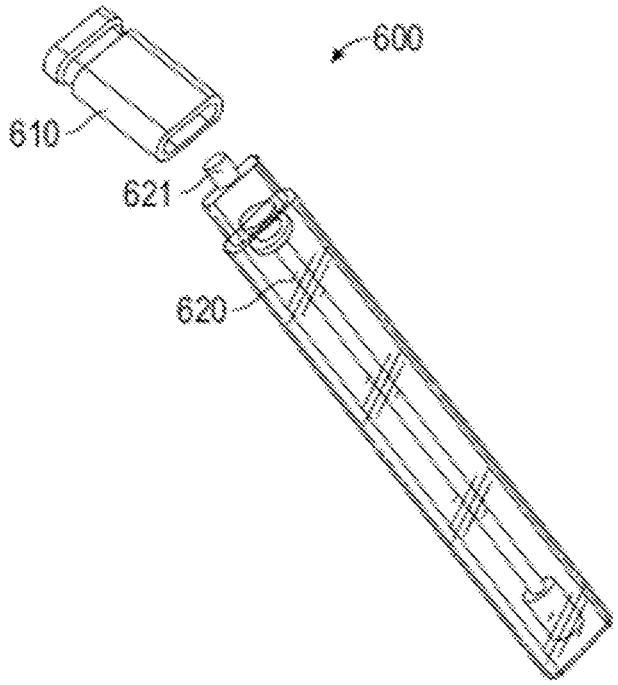
FIG. 6*a* is a perspective view of another example embodiment of a container of the portable personal storage device of FIG. 1.
Figure 6B:
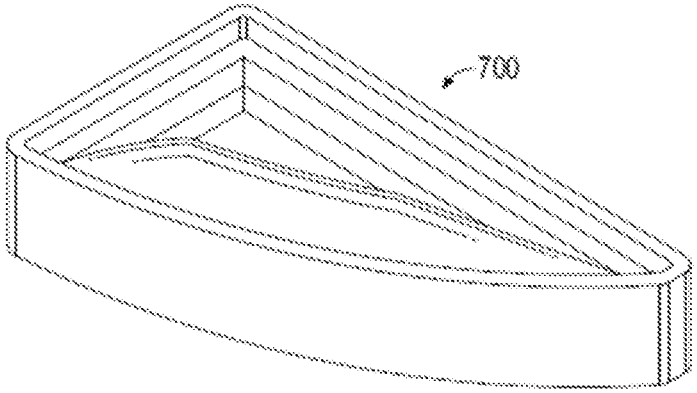
FIG. 6*b* is a perspective view of another example embodiment of a container of the portable personal storage device of FIG. 1.
Figure 7A:
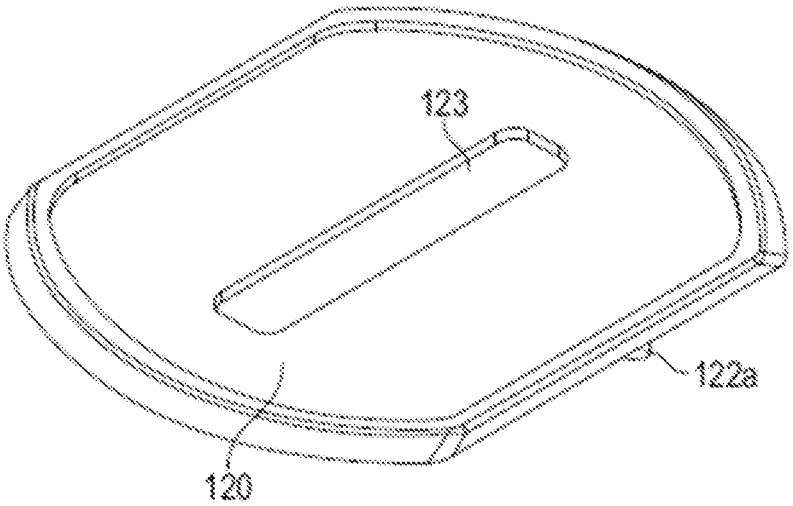
FIG. 7*a* is a perspective view of an example embodiment of a housing cover of the portable personal storage device of FIG. 1.
Figure 7B:
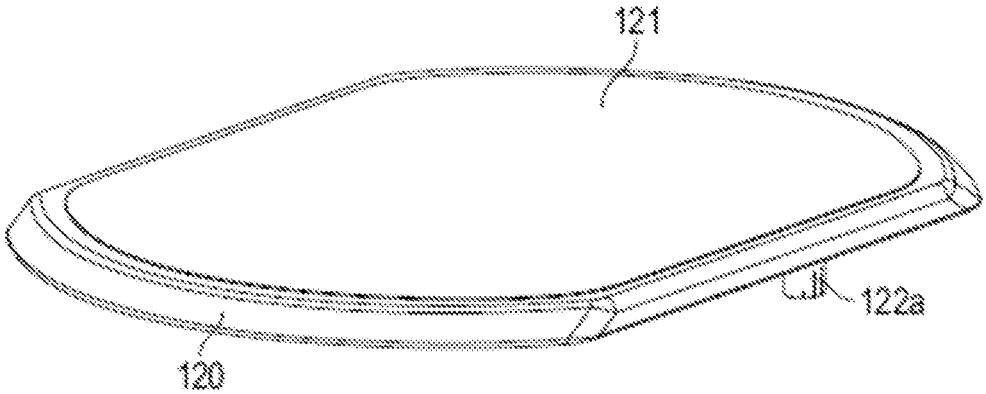
FIG. 7*b* is a perspective view of an example embodiment of a housing cover of FIG. 7*a* with a mirror attached thereto.
Figure 8:
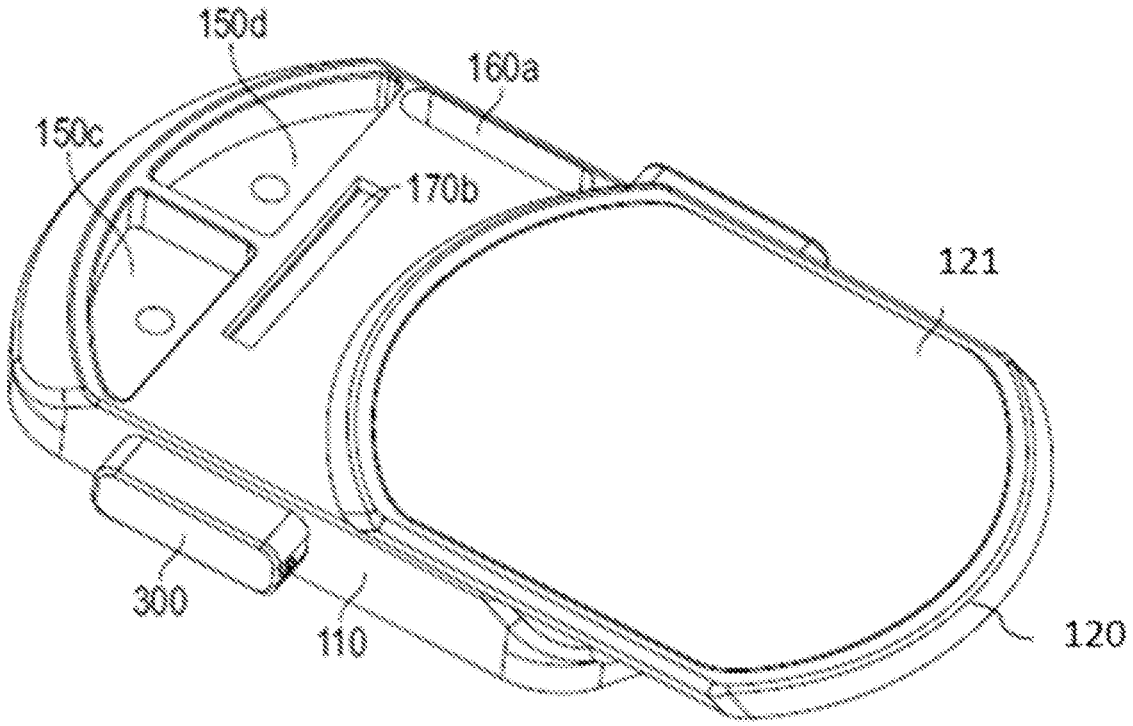
FIG. 8 is a perspective view of the portable personal storage device of FIG. 1 with the housing cover in an open position.
Figure 9:
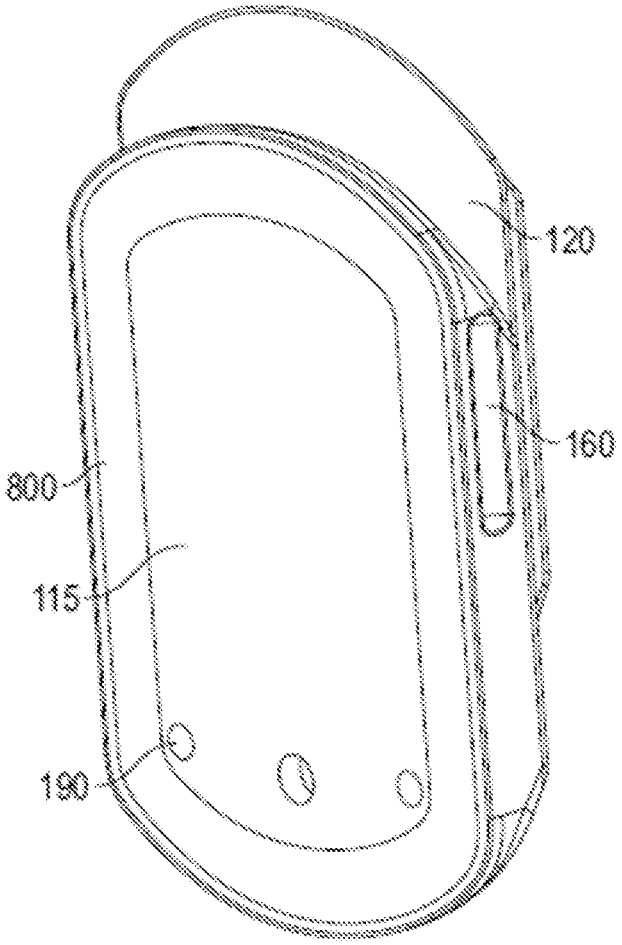
FIG. 9 is a perspective view of a back of the portable personal storage device of FIG. 1.

In further aspects, example embodiments of wellness instruments and/or containers are illustrated in FIGS. 4-6. Referring to FIGS. 4*a* and 4*b*, an example wellness container 300 may comprise a base 310 that is configured to detachably couple to a lid 320 via any suitable attachment mechanism (e.g., friction fit, snap fit, rotation, etc.). While the container 300 may be configured to contain a variety of wellness instruments, in the illustrated embodiment the container 300 is configured to house a cosmetic applicator 400 having a gripper 410, an operative tip 430, and a sheath 420 extending therebetween. To ensure secure and stable placement of the applicator 400 within the container 300, the lid 320 of the container 300 may be configured to detachably secure the gripper 410 of the applicator 400 therein. For example, the lid 320 may have a placement ring 321 on an upper, inner surface thereof having a diameter slightly larger than a diameter of the applicator gripper 410. The applicator gripper 410 may be detachably coupled to the placement ring 321 via, e.g., friction or snap fit, such that the sheath 420 of the applicator 400 extends into the container base 310 when the lid 320 and the container base 310 are detachably coupled together. In this way, the operative tip 430 of the applicator 400 is sufficiently spaced apart from interior walls of the container 300, to avoid contamination of the operative tip 430 and/or deposit of cosmetic media from the tip 430 on the interior walls of the container 300. In some embodiments, the applicator tip 430 may be removed prior to application of cosmetic media thereon.

Figure 10:
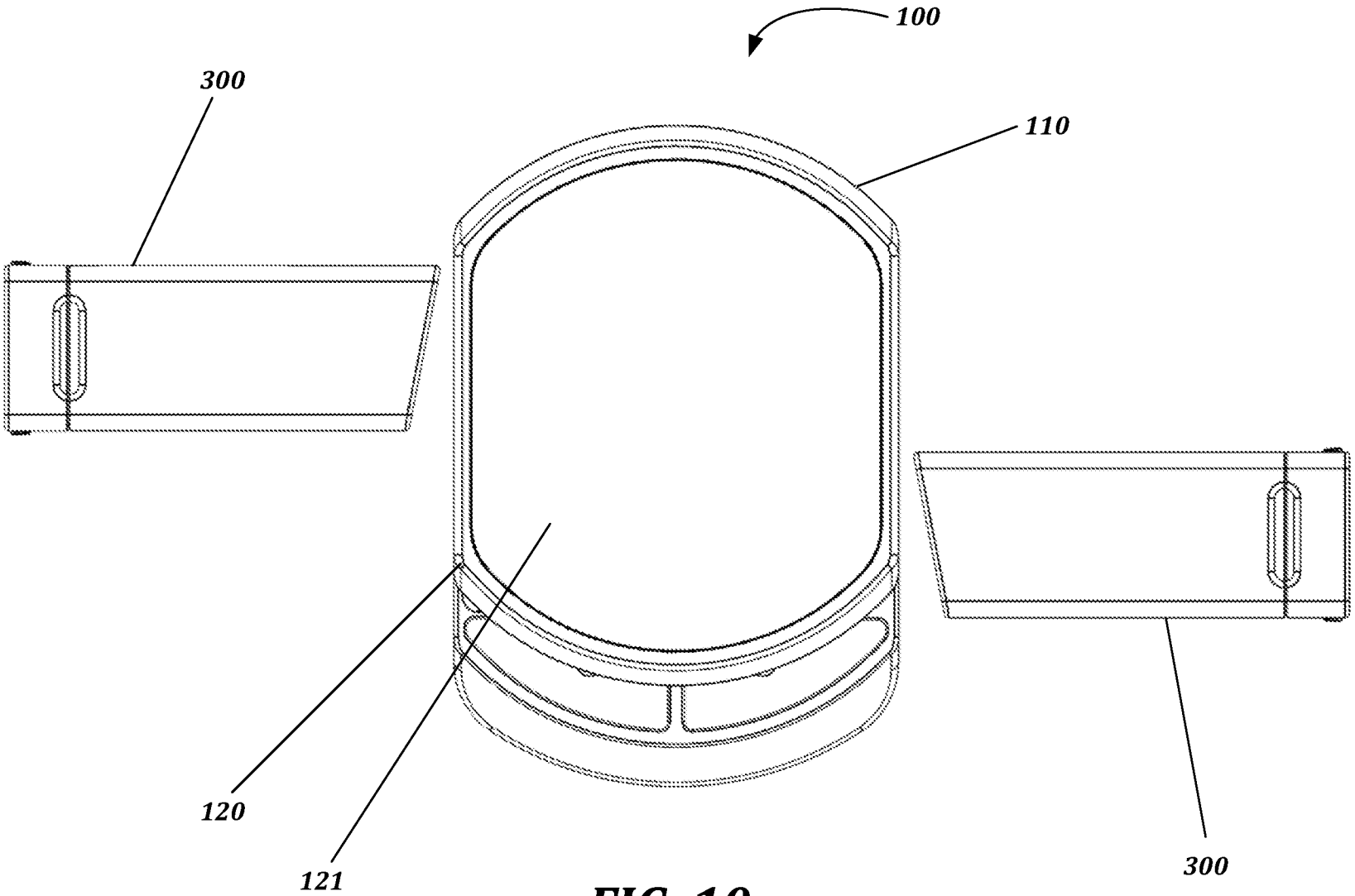
FIG. 10 is a top view of another example embodiment of a portable personal storage device.

In some aspects, the container 300 has a shape that assists with insertion into and/or removal from the housing 110. As shown in FIGS. 4C-4D, the end of the container base 310 comprising bottom surface 311 may be beveled. For example, such that bottom surface 311 forms a non-perpendicular angle with first and second opposing side surfaces 312, 313 of the container base 310. As shown in FIG. 10, the beveled shaped portion of the container base 310 would be configured as the end of container 300 to be inserted into each of cavities 150 of housing 110. One advantage of this configuration is that it can allow for ejection of the container 300 from within one of the plurality of cavities 150 upon sliding motion of the housing cover 120 with respect to the housing 110, as described in detail below. In further aspects, this configuration can advantageously allow for one-handed operation wherein sliding the housing cover can concurrently eject one or both containers 300 from housing 100 to allow for easy access and use.

While the container 300 is illustrated as housing only one applicator 400, it will be appreciated that the container 300 may be configured to house multiple applicators 400, for example, 2, 3, or 4 applicators or other wellness instruments therein. Where the container 300 is configured to house multiple applicators 400, the operative tips 430 of each applicator 400 may be spaced sufficiently apart from each other and/or from the interior walls of the container 300 to avoid contamination by cosmetic media left thereon. It will also be appreciated that a size of the container 300 may vary, e.g., to accommodate differently-sized wellness instruments and/or to allow for placement within differently-sized cavities 150 within the housing. For example, in some embodiments, the container 300 may be configured to contain solids for oral consumption, e.g., medication such as pills, breath mints, gum, etc.

Another embodiment of a wellness container is illustrated in FIG. 5. In this embodiment, the container is a sheath 500 configured to extend circumferentially around at least a portion of the applicator 400. Dimensions of the sheath 500 may be only slightly larger than dimensions of the applicator gripper 410 and/or the applicator sheath 420. In some embodiments, the sheath 500 may be moveable between a first position (illustrated in FIG. 4) where the operative tip 430 of the applicator 400 is exposed, and a second position where the operative tip 430 is at least partially encompassed within the sheath 500. The sheath 500 may be configured to attach to the gripper 410 and/or the operative tip 430 via any suitable attachment mechanism, e.g., friction fit, snap fit, etc. In some embodiments, the sheath 500 is attached to the applicator 400 during manufacturing and/or is permanently affixed to the applicator 400.

In some embodiments, the wellness containers may be configured to store wellness media therein. For example, tube 600 illustrated in FIG. 6*a* may be configured to contain a liquid substance, e.g., lip gloss, lotion, hair gel, medical ointment, liquid skin bandage (i.e., a topical skin treatment which binds to the skin to form a protective polymeric layer), and the like. The tube 600 may comprise a base portion 620 and a lid 610 configured to detachably couple to the base portion 620. To enable a user to access the substance contained within the tube 600, at least the base portion 620 may be composed of a soft, flexible material that can be squeezed to force the substance out via a small opening 621 at the top of the base portion 620. Another embodiment of a wellness container for containing wellness media therein is tray 700 illustrated in FIG. 6*b*. The tray 700 may be configured to hold a solid, gel or powdered substance therein, e.g., medical ointment, blush, concealer, lipstick, or the like. It will be appreciated that any of the aforementioned wellness instruments and containers that come into direct contact with wellness media (e.g., the container 300, the applicator 400, the tube 600, the tray 700) may be disposable and/or refillable.

In some embodiments, the device 100 may comprise a housing cover 120 that is slidably connected to the housing, e.g., to protect wellness products contained within the housing 110 when the device 100 is not in use. The housing cover 120 and the housing 110 may comprise a tongue and slot, or similar connecting arrangement configured to guide the housing cover along a predetermined travel path between an open position (FIG. 8), in which the third and fourth cavities 150*c*, 150*d* disposed on the front surface 111 of the housing 110 may be at least partially exposed, and a closed position (FIG. 1), in which the third and fourth cavities 150*c*, 150*d* are entirely covered. In the illustrated embodiment (FIGS. 7*a* and 7*b*), one or more protrusions 122*a*, 122*b* extending axially away from a bottom surface of the housing cover 120 are configured to slide within one or more corresponding slots 160*a*, 160*b* defined by the front surface 111 of the housing 110. A second or alternative tongue/slot mechanism may comprise protrusion 180 extending axially upwards from the front surface 111 of the housing 110, and which may be configured to slide within corresponding slot 123 defined by the housing cover 120. In the example embodiment, each of the slots 160*a*, 160*b*, 123 are sized to ensure that at least some portion of the housing cover 120 overlays the front surface 111 of the housing 110 when the housing cover 120 is in both the open and closed positions. It will be appreciated that the slots may constitute an aperture extending all the way from one surface to an opposing surface of the housing 110 and/or the cover 120 (as in the case of the slots 123, 160*a*, 160*b*), or may constitute an indentation in a surface of the housing 110 and/or the cover 120.

In some embodiments, sliding movement of the housing cover 120 with respect to the housing 110 may assist with removal of wellness instruments and/or containers from the housing 110. For example, engagement of at least one of the protrusions 122*a*, 122*b* with an exterior surface of the container 300 may cause the container 300 to be at least partially ejected from the cavity 150 in which the container 300 is seated. In particular, at least one of the protrusions 122*a*, 122*b* may sit adjacent to a first edge of a beveled bottom surface 311 of the container 300 while the housing cover 120 is in the closed position with respect to the housing 110. As the housing cover 120 slides into the open position, at least one of the protrusions 122*a*, 122*b* may similarly slide along the beveled surface 311 of the container 300, causing the container 300 to be at least partially ejected from the housing 110. In some embodiments, when the housing cover 120 is in the open position, the container 300 will extend sufficiently outside of the housing 110 to enable a user to grab the container 300 with their fingers. In such embodiments, it will be appreciated that a longitudinal length of the protrusions 122*a*, 122*b* is sufficient to enable the protrusions 122*a*, 122*b* to extend far enough into the cavity 150 to make contact with a wellness instrument or container seated therein.

Figure 3:
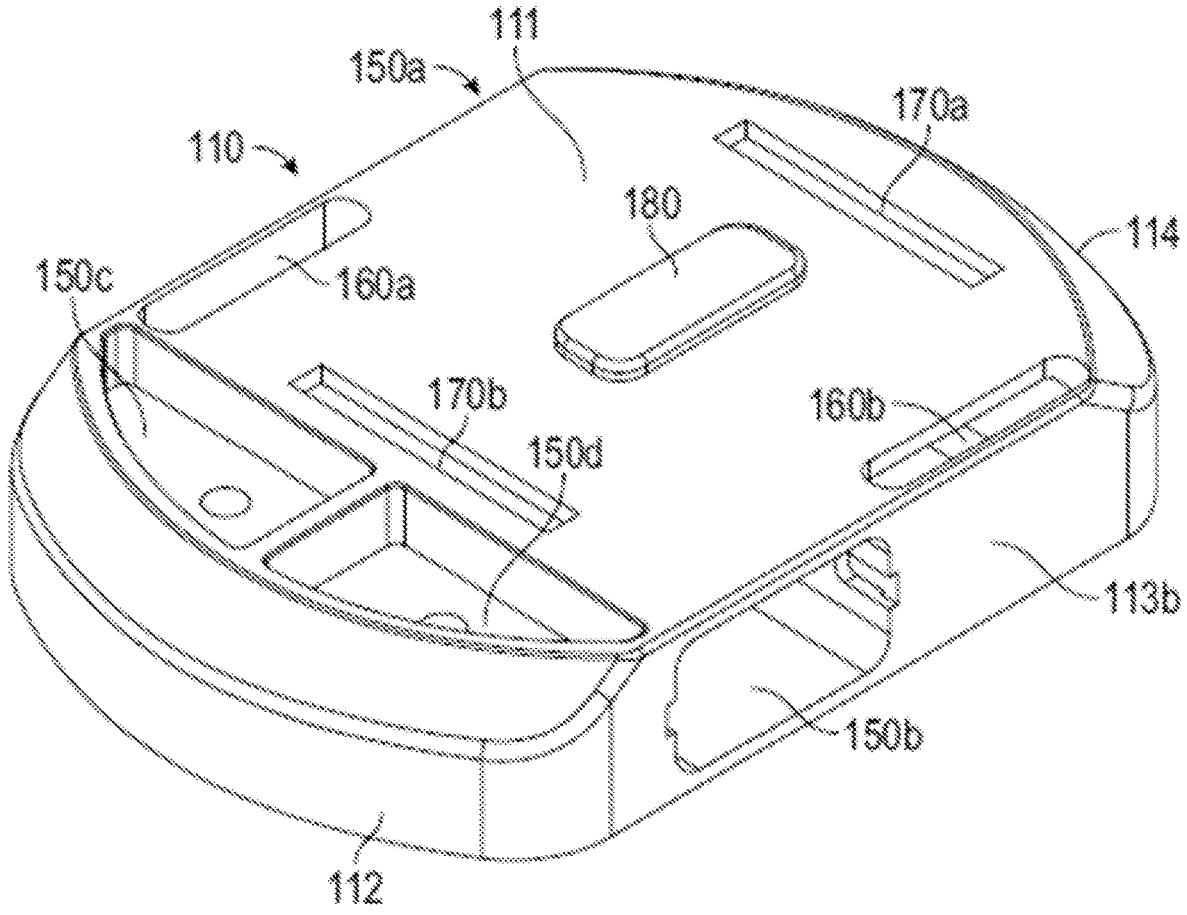
FIG. 3 is perspective view of an example embodiment of a housing of the portable personal storage device of FIG. 1.

In addition or alternatively to the tongue and slot connection, the housing cover 120 may be detachably coupled to the housing 110 via a variety of attachment mechanisms. In the illustrated embodiment, the attachment mechanism is a magnetic attachment mechanism comprising one or more magnets disposed within cavities formed within the housing 110. Referring to FIG. 3, first and second slots 170*a*, 170*b* are defined by the front surface 111 of the housing 110 and configured to store first and second elongate magnets, respectively. Once secured within the slots 170*a*, 170*b*, the magnets may be configured to detachably connect to a magnetic component within the housing cover 120, with sufficient strength to ensure that the housing cover 120 does not accidentally become disconnected from the housing 110 during regular use of the device 100. Such connection may enable the user to access wellness products contained within the cavities 150 on the front surface 111 without risking losing the housing cover 120. In some embodiments, arrangement of the magnets may help to secure the housing cover 120 in place in both the open and closed positions. For example, the first magnet seated within the first, lower slot 170*a* may be configured to secure the housing cover 120 in place when in the open position, and the second magnet seated within the second, upper slot 170*b* may be configured to pull the cover 120 into place in the closed position.

In some embodiments, the housing cover 120 comprises a mirror 121 or mirrored surface, which may assist with use of the wellness instruments and/or containers. The mirror 121 or mirrored surface may be disposed on a top surface of the housing cover 120, to ensure accessibility, and/or may cover all or only a portion of the top surface of the housing cover 120. In the illustrated embodiment, the mirror 121 is configured to be seated within a cavity defined by the front surface of the housing cover 120. Dimensions of the mirror 121 are almost the same as dimensions of the front surface of the housing cover 120, such that the front surface forms a small bevel around a perimeter of the mirror 121. It will be appreciated that the mirror 121 itself provides functionality independent of the wellness instruments and/or containers contained within the device 100.

In some embodiments, the housing cover 120 may additionally or alternatively comprise a brand marking denoting a type or origination of the wellness instruments and/or media designed to be housed inside.

Figure 2:
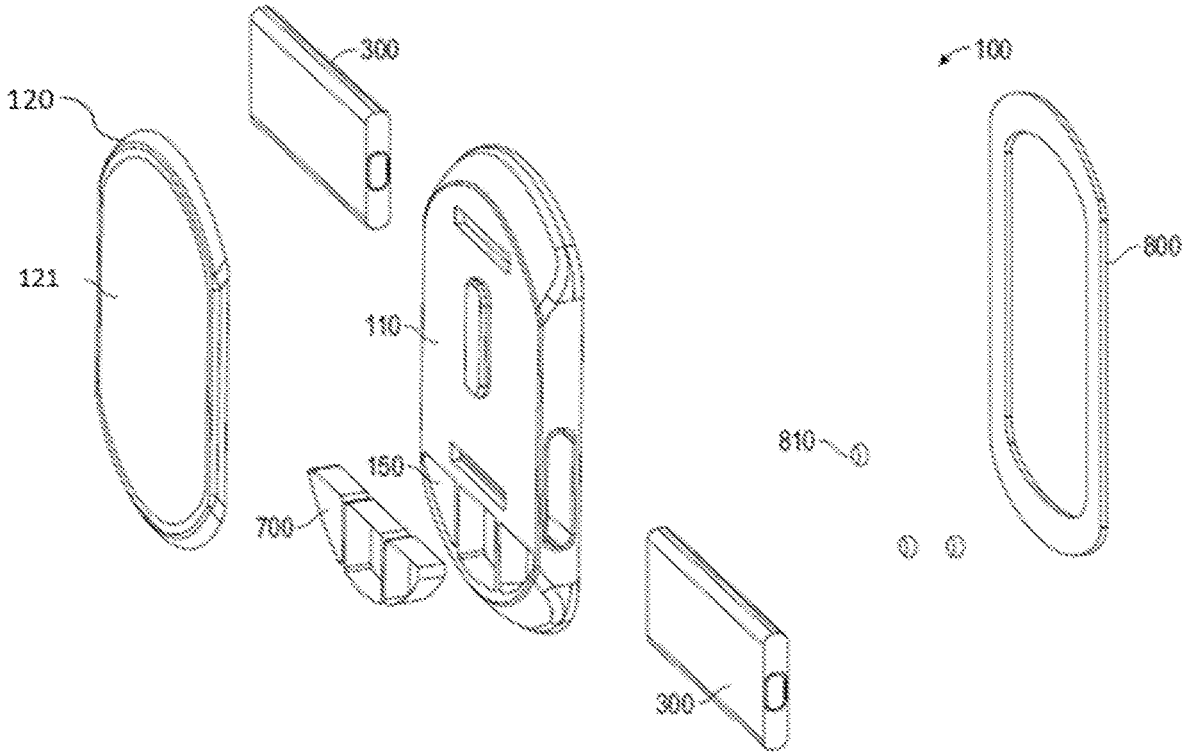
FIG. 2 is an exploded perspective view of the portable personal storage device of FIG. 1.

To facilitate use and/or portability, the housing 120 may be configured to attach to the surface 200 using an attachment mechanism. The attachment mechanism may comprise a magnetic attachment mechanism, an adhesive attachment mechanism, a fastening means, or the like. In some embodiments, the magnetic attachment mechanism may comprise one or more magnets 810 disposed on or in corresponding portions of the housing 110 effective to allow the housing 110 to be detachably coupled to a magnetic surface. As shown in FIG. 2, the magnets 810 may be disc-shaped and/or configured to be seated within one or more cavities 190 disposed on a back surface 115 of the housing 110. The magnets 810 may be sufficient in strength and number to form a magnetic attachment to the magnetic surface that prevents accidental removal of the device 100 from the surface 200. In the illustrated embodiment of FIGS. 2 and 9, there are three cavities 190 configured to seat three magnets 810, but the number of magnets may be within a range of about 1 to 10. In some embodiments, the magnetic surface may comprise a base plate or ring 800 configured to attach to the surface 200, e.g., via an adhesion mechanism. The one or more magnets 810 disposed on or in corresponding portions of the housing 100 may then be effective to allow the housing 110 to be detachably attached to the base plate or ring 800, which in turn may be coupled to the surface 200. It will be appreciated that the portable personal storage device 100 may attach to the surface 200 in a variety of desired functional positions, e.g., with the lateral surfaces 113*a*, 113*b* oriented substantially perpendicularly to a longitudinal axis of a mobile device case.

The attachment mechanism for detachably coupling the housing cover 120 to the housing 110 may be spaced substantially apart from the attachment mechanism for detachably coupling the housing 110 to the surface 200, in order to avoid interference between the two attachment mechanisms. In the illustrated embodiment, the separation is accomplished by housing the magnets for attaching to the housing cover 120 within a front portion of the housing 110, while the magnets 810 for attaching the housing 110 to the surface 200 are housed within a back portion of the housing 111. Specifically, the magnets of the first attachment mechanism may be housed within the slots 170*a*, 170*b* on the front surface 111 of the housing 110, while the magnets 810 of the second attachment mechanism may be housed within cavities 190 on the back surface of the housing 110.

The surface 200 may comprise any substantially planar surface, and preferably a surface that is portable such as a mobile device or a case for a mobile device. However, it is also possible for the device 100 to be detachably coupled to a fixed surface such as a wall, a desk, a mirror, etc., such that the device 100 can be used to apply wellness products within a fixed location such as a home.

Figure 11:
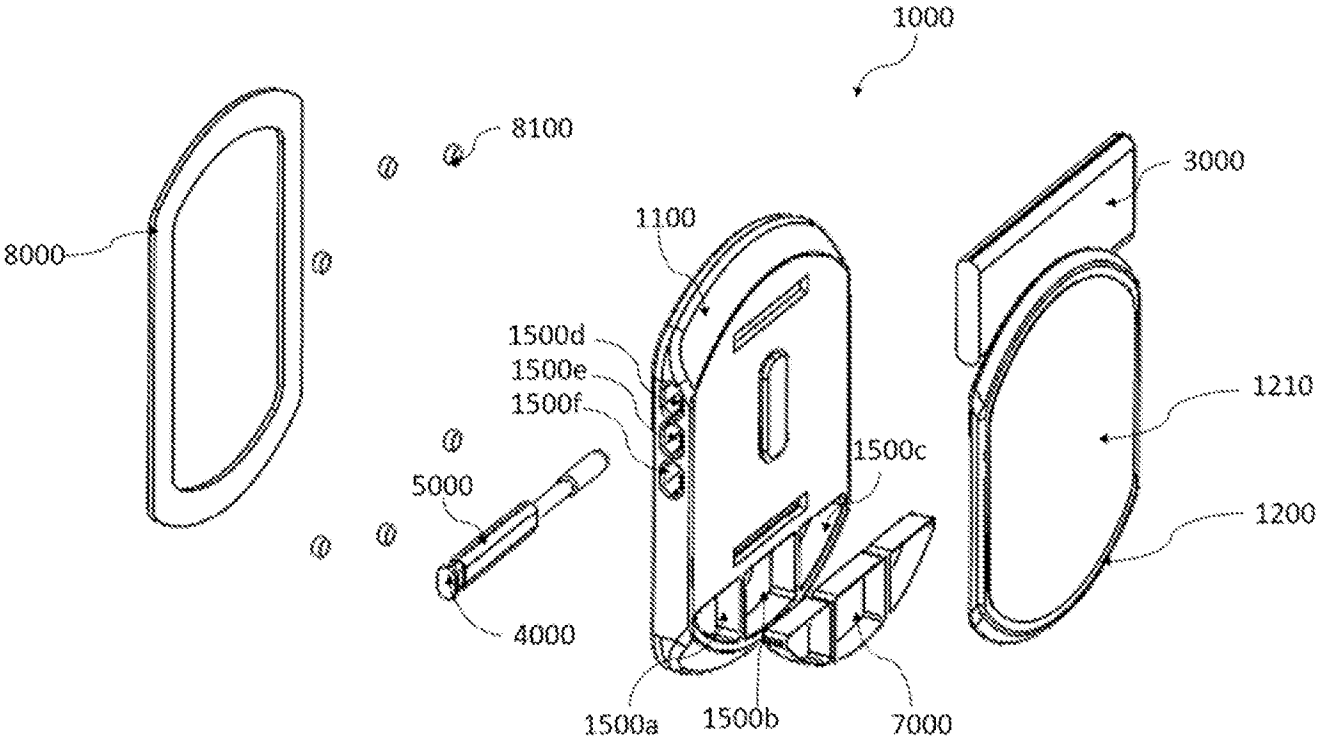
FIG. 11 is an exploded view of another example embodiment of a portable personal storage device.

An alternative embodiment of a portable personal storage device 1000 is illustrated in FIG. 11. In this embodiment, the portable device 1000 comprises a larger number of cavities 1500 for detachably storing a larger number of wellness instruments and/or containers therein. For example, this embodiment includes three cavities 1500*a*, 1500*b*, and 1500*c* defining trays on a top surface of the housing 1100 and three cavities 1500*d*, 1500*e*, and 1500*f* defining openings on a lateral surface of the housing 1100. This and other embodiments described herein illustrate the versatility of the design, which can be re-configured to accommodate a great variety of wellness instruments, containers, and/or media.

Figure 12:
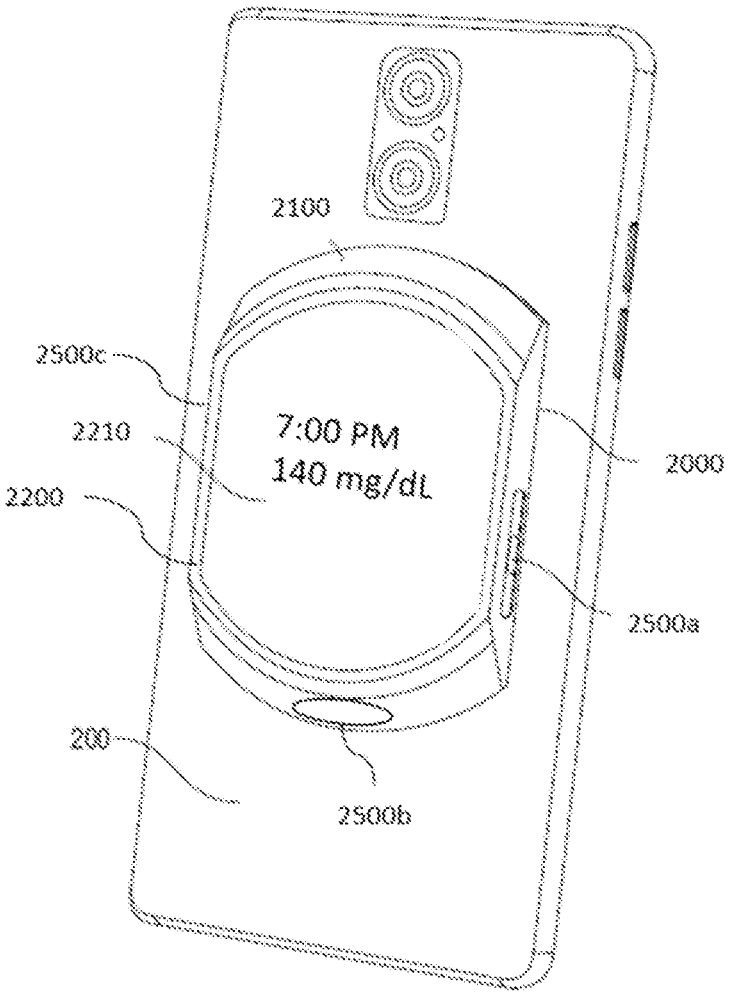
FIG. 12 is a perspective view of another example embodiment of a portable personal storage device.

Yet another alternative embodiment of a portable personal storage device 2000 is illustrated in FIG. 12. In this embodiment, the portable device 2000 is configured to store one or more medical devices therein. By way of non-limiting example, the device 2000 may have three cavities 2500*a*, 2500*b*, 2500*c* that are each configured to store one or more medical devices therein for personal use on the go, e.g., to check blood glucose levels. The medical devices may include a device for collecting a blood sample, e.g., a needle, lancet, etc., a substrate for collecting the blood sample, e.g., a test strip, and/or a fingerprint detection device. In some embodiments, a glucose sensing system is housed within the housing 2100 or the housing cover 2200, thereby enabling analysis of a blood sample on-the-go. Instead of a mirror, a housing cover 2200 may have a display screen 2210 thereon for displaying information relevant to the user's wellness, e.g., a time of blood collection and/or a result of the blood glucose analysis from the glucose sensing system.

Any of the above-described device components may be attached to one another using a connecting means. In still further aspects, the connecting means can comprise a fitting, insert, adhesive, brazing, soldering, welding, spot weld, screw with nut, rivet, threading, friction fit, snap-fit, twist-lock, or interlocking mechanism or a combination thereof. In yet further aspects, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the device can comprise an engagement means for coupling and holding components together. In a further aspect, the engagement means can be a screwing mechanism, a click-lock mechanism, or friction mechanism, or the like.

The device 100 and/or the wellness instruments and/or containers disclosed herein may be comprised of a sturdy, yet slightly flexible material, such a light metal or plastic, which allows the device to be a substantially lightweight (e.g., for ease of portability), adjustable, and rigid. The device 100 and/or the wellness instruments and containers disclosed herein may be constructed from other materials, such as a metallic magnetized material, plastic material, wooden materials, composite materials, a 3-D printing ribbon cable, and other suitable materials.

As alluded to above, the portable personal storage device solves many of the problems and challenges from the prior art. For example, device of the present disclosure eliminates the need to carry a mirror and makeup bag everywhere. In addition, the device eliminates the need to be in a bathroom to apply personal wellness products. The device can even address the challenge of keeping track of small wellness items in an effort to prevent them being misplaced or dropped.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and sub-combinations described in the detailed description. It is to be understood that both the foregoing description are and explanatory only and are not restrictive of the disclosure, as claimed. While the present disclosure may relate primarily to cosmetic uses of the mirror and assembly, there may be other suitable uses and contexts (i.e., for medical uses, for dental uses, for grooming uses, and the likeness thereof).

Personal Storage Device Operation and Method for Using

Figure 13:
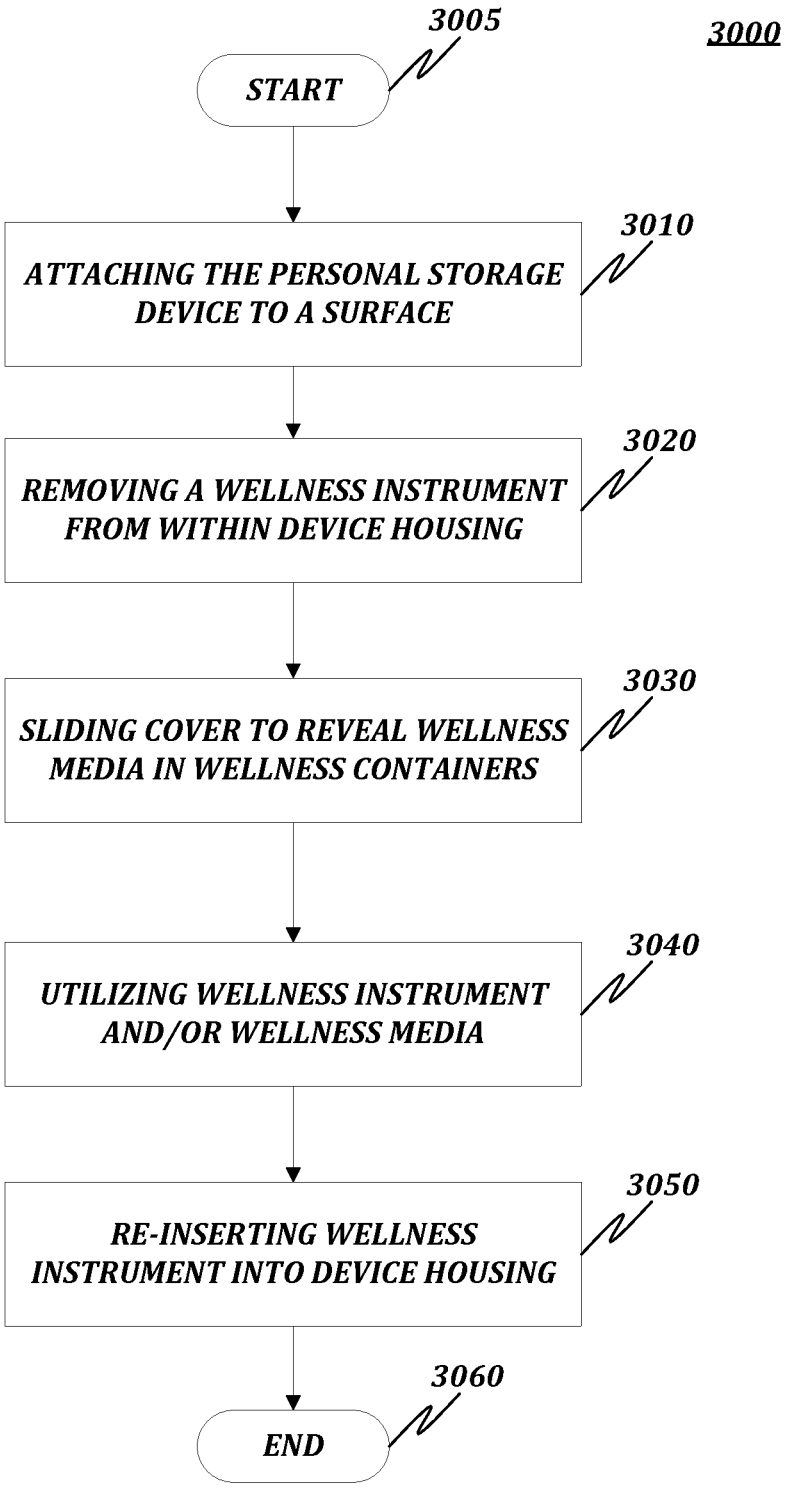
FIG. 13 is a flow chart of a method for providing a portable personal storage device in accordance with the present disclosure.

FIG. 13 is a flow chart setting forth the general stages involved in a method 3000 consistent with an embodiment of the disclosure for providing the portable wellness tool assembly disclosed herein. Method 3000 may be implemented using the portable personal storage devices as described in more detail below with respect to FIGS. 1-12.

Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein. Ways to implement the stages of method 3000 will be described in greater detail below.

Method 3000 may begin at starting block 3005 and proceed to stage 3010 where the device 100 may be attached to the surface 200. For example, the device 100 may be magnetically attached to a back of a mobile device case, a purse strap, a belt, a garment, etc.; in some embodiments, the attachment may occur via a base plate or ring 800. From stage 3010, where the device 100 is attached to the surface 200 and may be moved into an effective operating mode position, method 3000 may advance to stage 3020 where a wellness instrument, e.g., the applicator 400, may be removed from the housing 110. Once the wellness instrument is removed from the housing 110 in stage 3020, the method 3000 may continue to stage 3030 where the cover 120 may slide up to an open position to reveal the wellness containers containing wellness media therein at an effective operating mode position. The user may then use the wellness instrument and/or media as needed. After applying the wellness media and/or using the wellness instrument in stage 3040, method 3000 may proceed to stage 3050 where wellness instrument may be inserted back into its respective garage or pocket 160 in the housing 110. Once the wellness instrument is reinserted in stage 3050, method 3000 may then end at stage 3060 where the cover 120 is returned back to cover the wellness containers and/or media in a closed position.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A personal storage device comprising:

a housing configured to attach to a surface via a first attachment mechanism, the housing comprising:

a plurality of predefined cavities configured to removably store one or more wellness instruments and one or more wellness containers, each of the plurality of predefined cavities comprising an opening disposed on an outer surface of the housing;

at least one of: a replaceable wellness instrument or a replaceable wellness container, a protrusion extending upward from a front surface of the housing, and a slot extending from the front surface of the housing into a first cavity, of the plurality of predefined cavities;

a container configured to fit within and be retained by the first cavity, the container comprising at least one beveled surface; and a housing cover slidably connected to the front surface of the housing, the housing cover comprising:

a slot defined in the housing cover and configured to receive the protrusion of the housing, a protruding lever extending from a rear surface of the housing cover, the protruding lever extending through the slot in the housing into the first cavity, wherein the housing cover is configured to slide between a closed position and an open position, and wherein the protruding lever causes ejection of the container from the first cavity as the housing cover slides from the closed position to the open position.

2. The device of claim 1, wherein the first attachment mechanism comprises one or more magnets disposed within a back portion of the housing, the one or more magnets being effective to detachably couple the housing to a magnetic surface.

3. The device of claim 2, wherein the magnetic surface is a base plate configured to attach to the surface via an adhesive mechanism.

4. The device of claim 1, wherein a second attachment mechanism comprises one or more magnets disposed within a front portion of the housing.

5. The device of claim 1, wherein the protrusion of the housing is received by the slot in the housing cover to guide the housing cover along a predetermined travel path between the open position and the closed position.

6. The device of claim 5, wherein movement of the housing cover along the predetermined travel path is effective to eject the container from the first cavity via engagement of the protruding lever of the housing cover with the beveled surface of the container.

7. The device of claim 1, wherein the housing cover comprises a mirror or mirrored surface.

8. The device of claim 1, wherein the housing cover comprises a display screen.

9. The device of claim 1, wherein at least two of the plurality of predefined cavities are disposed on opposing lateral surfaces of the housing.

10. The device of claim 1, wherein at least two of the plurality of predefined cavities are disposed on a front surface of the housing.

11. The device of claim 1, wherein a volume of the plurality of predefined cavities constitutes greater than 70% of a total volume of the housing.

12. The device of claim 1, wherein the replaceable wellness instrument comprises one or more of lip gloss, lip stick, or an applicator.

13. The device of claim 1, wherein the replaceable one wellness instrument is a portable medical device.

14. The device of claim 1, wherein the replaceable wellness container is a container for storing powdered or liquid wellness media.

15. The device of claim 14, wherein the wellness media is blush, foundation, or eye shadow.

* * * * *